US010995628B2

(12) United States Patent
Mache et al.

(10) Patent No.: US 10,995,628 B2
(45) Date of Patent: May 4, 2021

(54) METHOD FOR CONTROLLING A TURBOMACHINE VALVE

(71) Applicant: SAFRAN AIRCRAFT ENGINES, Paris (FR)

(72) Inventors: Florian Mache, Moissy-Cramayel (FR); Arnaud Rodhain, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 28 days.

(21) Appl. No.: 16/463,002

(22) PCT Filed: Nov. 22, 2017

(86) PCT No.: PCT/FR2017/053207
§ 371 (c)(1),
(2) Date: May 22, 2019

(87) PCT Pub. No.: WO2018/096264
PCT Pub. Date: May 31, 2018

(65) Prior Publication Data

US 2019/0368368 A1 Dec. 5, 2019

(30) Foreign Application Priority Data

Nov. 22, 2016 (FR) ..... 1661340

(51) Int. Cl.
*F01D 11/24* (2006.01)
*F01D 9/06* (2006.01)

(52) U.S. Cl.
CPC ..... *F01D 11/24* (2013.01); *F01D 9/065* (2013.01); *F05D 2270/11* (2013.01);
(Continued)

(58) Field of Classification Search
CPC ..... F01D 11/24; F01D 11/20; F01D 11/22; F01D 11/14; F01D 9/065; F01D 9/06;
(Continued)

(56) References Cited

U.S. PATENT DOCUMENTS 6,231,306 B1 * 5/2001 Khalid ..... F01D 17/08 415/118
7,650,777 B1 * 1/2010 Krok ..... F01D 17/08 73/112.06

FOREIGN PATENT DOCUMENTS

EP 1 550 791 A2 7/2005
EP 3 091 194 A1 11/2016
(Continued)

OTHER PUBLICATIONS

Communication dated Jul. 17, 2017 from French Patent Office in FR Application No. 1661340.
(Continued)

*Primary Examiner* — Igor Kershteyn
*Assistant Examiner* — Joshua R Beebe
(74) *Attorney, Agent, or Firm* — Sughrue Mion, PLLC

(57) ABSTRACT

The invention concerns a method for controlling a control valve (20) of a turbomachine operating at an engine speed at a cruise value (Vc) and oscillating around the cruise value (Vc) of same, the method being implemented by a calculation unit (40), and being characterised in that it comprises a step of determining a position control for the control valve (20), filtered of the oscillations of the engine speed around the cruise value (Vc).

12 Claims, 5 Drawing Sheets

(52) U.S. Cl.
CPC ..... *F05D 2270/20* (2013.01); *F05D 2270/44* (2013.01); *F05D 2270/64* (2013.01)

(58) Field of Classification Search
CPC ..... F05D 2270/11; F05D 2270/20; F05D 2270/44; F05D 2270/64
USPC ..... 415/1
See application file for complete search history.

(56) References Cited

FOREIGN PATENT DOCUMENTS

| | | | |
|---|---|---|---|
| FR | 2 630 500 | A1 | 10/1989 |
| GB | 2 057 574 | A | 4/1981 |
| WO | 2007/086893 | A2 | 8/2007 |

OTHER PUBLICATIONS

International Search Report for PCT/FR2017/053207 dated Feb. 7, 2018 [PCT/ISA/210].

* cited by examiner

METHOD FOR CONTROLLING A TURBOMACHINE VALVE

GENERAL TECHNICAL FIELD

The invention relates to the turbomachines and to the methods or devices for controlling valves monitoring an air flow, and in particular the LPTACC ("low pressure turbine active clearance command" according to the terminology used in aeronautics) valves, that is to say the valves that are intended to monitor the clearance between a turbine blade and a casing radially disposed thereabout. By injecting air on the casing, it is possible to cool the latter and to monitor its thermal expansion, which causes a decrease of its size and therefore a decrease in the clearance.

The expansion of the elements depends on several parameters, including the materials, the assemblies, the rotational speed, the temperature, etc. The LPTACC valve can therefore affect the temperature of the casing.

The clearance is modulated according to the flight phases, the engine speed, the altitude, etc.

STATE OF THE ART

Figure 1A:
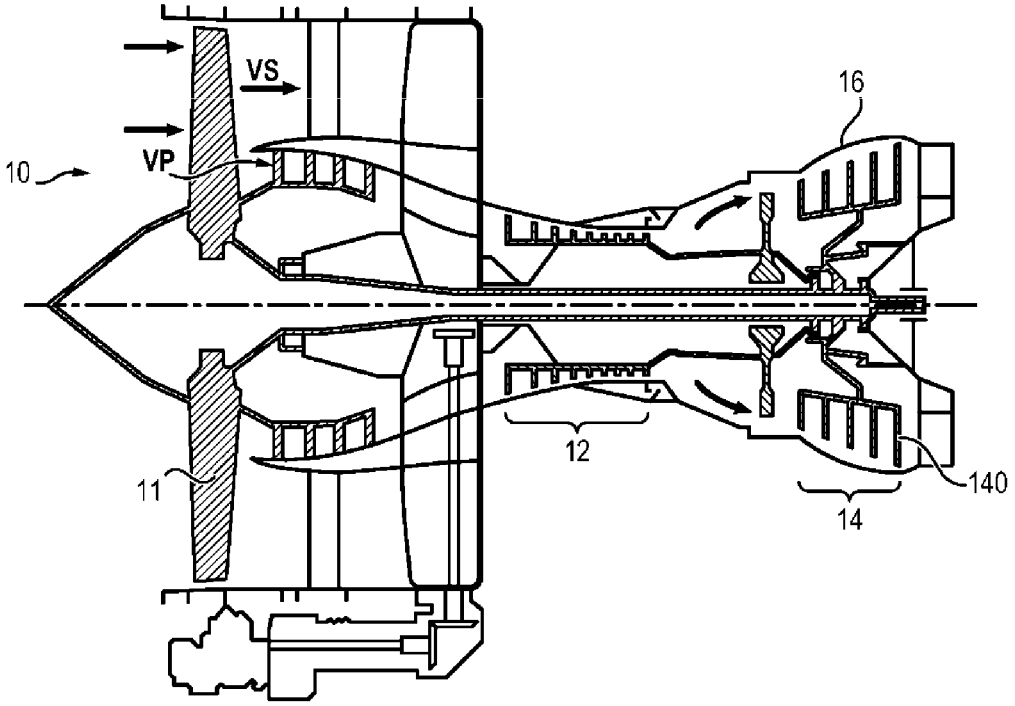

A bypass turbomachine 10 for aeropropulsion is represented in FIG. 1*a*. It comprises a fan 11 delivering an air flow, a central portion of which is injected into a primary flow path VP comprising a compressor 12 that supplies a turbine 14 driving the fan. The turbine 14 comprises a plurality of radially extending blades 140 and is radially housed inside a casing 16.

The peripheral portion of the air flow from the fan circulates in a secondary flow path VS. This peripheral portion of the air flow is ejected to the atmosphere in order to provide most of the thrust of the turbomachine 10.

Figure 1B:
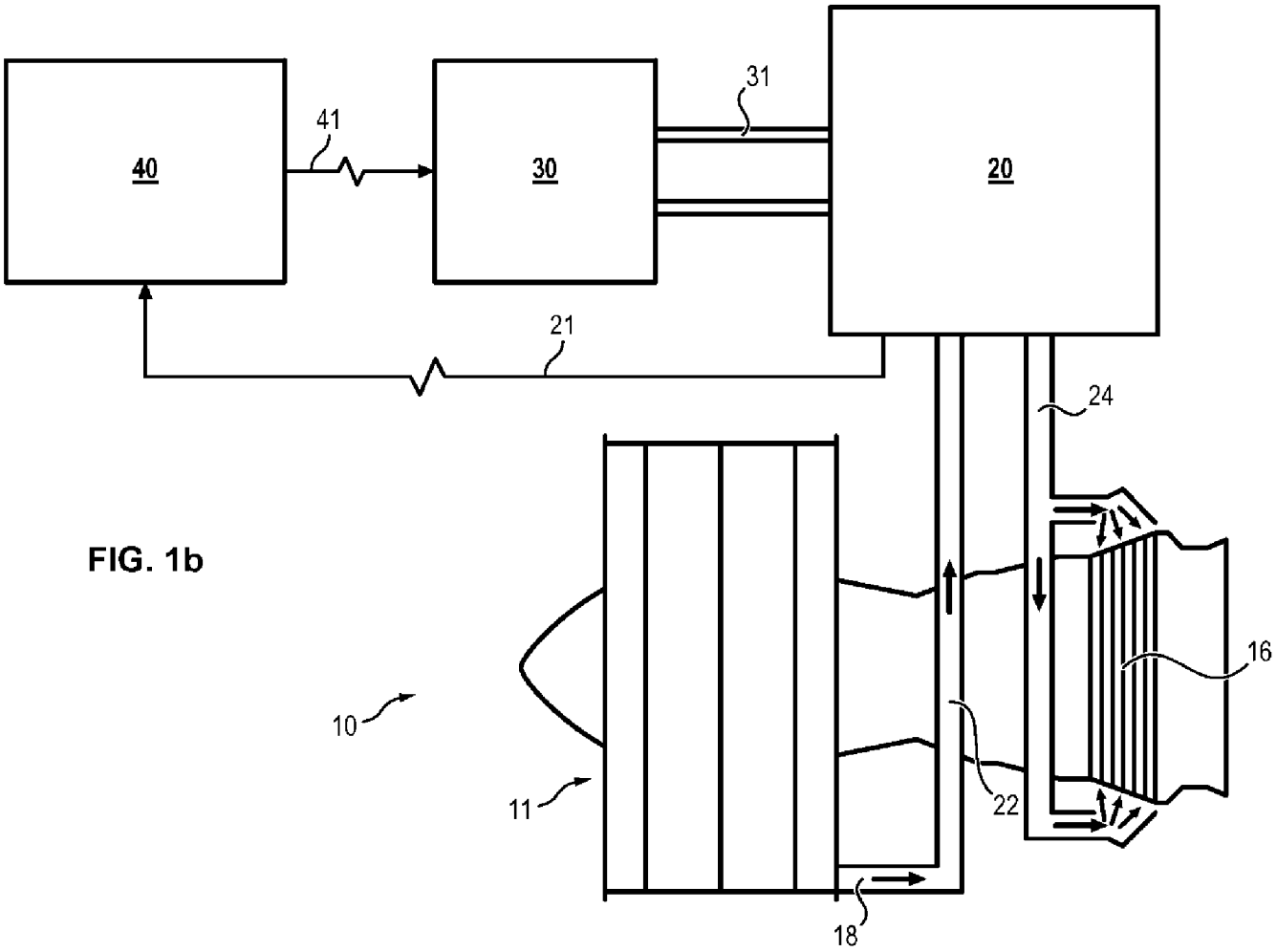

In order to monitor the clearance between the blades 140 of the turbine 14 and the casing 16, a monitoring valve 20, which is preferably of the LPTACC type, is provided. FIG. 1*b* schematically illustrates the architecture of the environment of this valve 20 and its active monitoring.

This monitoring valve 20 makes it possible to continuously monitor an air flow rate from the secondary flow path, from a sample 18, and to direct it towards the casing 16 disposed opposite the blades 140 of the turbine 14. The sampling 18 communicates with a supply duct 22 that brings the air flow to the monitoring valve 20. A discharge duct 24 then brings this air from the monitoring valve 20 to the casing 16.

A calculation unit 40 receives in particular, as input, the value of the engine speed and calculates a flow rate command which is converted into a position command. This position command is sent to an actuator 30 that pilots the valve 20. Position sensors (not represented) allow a return to the calculation unit 40.

In FIG. 1*b*, it is a hydraulic actuator 30 that pilots a hydraulic servo-valve 20. The link 41 between the calculation unit 40 and the actuator 30 is electric. The link 31 between the actuator 30 and the valve 20 is hydraulic. The return link 21 between the monitoring valve 20 and the calculation unit 40 is electric.

The active monitoring is mainly aimed to reduce the clearance at the turbine 14 blade 140 tip to optimize the specific consumption, that is to say the amount of fuel required to produce a thrust of one Newton for one hour.

One of the objectives of the monitoring is to define an optimal air flow rate for the active monitoring, making it possible to limit as much as possible the clearance at the blades 140 tip while minimizing the amount of air taken from the fan, because the air flowing by this means does not directly contribute to the thrust provided by the turbomachine 10. This objective is mainly aimed during the cruise phases (that is to say the steady state).

The service life of these monitoring valves is often shorter than the one expected by the manufacturers. Solutions have consisted in strengthening the valves, by using more resistant materials, but the problem is only partially solved.

PRESENTATION OF THE INVENTION

As indicated in the introduction, the invention relates to the turbomachine 10 monitoring valves 20 and methods associated thereto. The elements and their references indicated in the introduction will be reused for the description below.

The methods for controlling the monitoring valve 20 generally comprise the following steps implemented by the calculation unit 40:

- A step E1 of receiving data quantifying the engine speed of the turbomachine,
- A step E2 of determining a flow rate command in particular from the data quantifying the engine speed,
- A step E3 of determining a position command from the flow rate command.

The position command is intended to allow the piloting of the valve 20, in particular via an actuator 30 if the latter is not integrated to the valve 20.

Other data intervene for the position command, in particular the constants of the actuator 30 transfer function. These known data do not relate directly to the invention and will not be further detailed.

Other steps are then involved, such as a step of piloting the valve by the actuator, the latter receiving, as input, the position command of step E3. These steps do not relate to the calculation unit 40 directly.

It has been observed on the existing equipment that the service life of the monitoring valves was lower than expected. As indicated in the introduction, corrective actions regarding the quality of the materials have been initiated but could only temporarily and partially solve the problem.

In further studies, the Applicant has found that the monitoring valve 20 oscillates about its equilibrium position. The amplitude of these oscillations is small compared to the value of the command, but the frequency is high compared to the thermal response of the casing 16.

These oscillations can represent up to two thirds of the total stroke of the valve 20 during a flight and thereby cause premature wear of the valve 20.

Nevertheless, the Applicant has also noticed that the oscillations are not due to the air flow which could generate disturbances but are due to step E2 of determining the flow rate command. However, the step E3 of determining the position command of the valve directly follows step E2.

It has thus been found that the flow rate command provided by the calculation unit 40 is very sensitive to the oscillations of the engine speed that varies by a few percent when it is in cruise mode. A cruise value Vc is now defined about which the engine speed oscillates at a frequency fo and an amplitude Ao (Ao being small compared to Vc, typically less than 5% of Vc). The frequency fo is of about 1 Hz (variable depending on the turbomachines).

Since, in the cruise phase, the position command of the valve 20 is substantially proportional to the engine speed, this oscillation of the speed results in an oscillation of the position control.

The engine speed can in particular be obtained by sensors measuring the rotational speed of the shaft of the low pressure turbine.

By way of illustration, the flow rate change induced by these oscillations of the position command is of about 5%. Because of its value and frequency, such a change has no physical utility since the thermal response time of the casing 16 is slower.

The invention then proposes a control method comprising a step of determining, for the monitoring valve 20, a position command, filtered from the oscillations of the engine speed about the cruise value Vc.

In particular, the filtering uses a low-pass filter whose cutoff frequency is greater than a frequency associated with the thermal response time of the casing, in order make ensure that the filtering does not disturb the function of the valve.

Indeed, the oscillation of the valve being due to an oscillation of the position command, an adapted filtering makes it possible to suppress the noise of the signal and to optimize the management of the valve. The cumulative stroke of the valve can thus be divided by three on a flight, which increases its service life.

The filtering is carried out using a low-pass filter, whose cutoff frequency fc is lower than the frequency of the oscillations fo, in order to attenuate them. More generally, the cutoff frequency fc is chosen to attenuate the oscillations during the entire cruise phase.

The filtering provided in the method makes it possible to limit the influence of the oscillations on the position command and thus to improve the service life of the valve 20.

In view of the architecture of the steps performed in the calculation unit, the filtering can be performed on different signals but produces in fine a similar result, namely the position command is filtered from the oscillations of the engine speed.

The invention advantageously applies to the LPTACC valves, (that is to say intended to supply air to the casing in order to modify its expansion), but also to any type of valve whose calculation unit that pilots it receives, as input, data relating to the engine speed and therefore applies to the valves whose position oscillates in response to the engine speed oscillations. These valves monitor fluid flows, in particular air flows.

Finally, the invention may have the following characteristics, taken alone or in combination:

the determination step comprises the following sub-steps:

(E1) receiving data quantifying the engine speed of the turbomachine, (E2) determining a flow rate command from the data quantifying the engine speed, (E3) determining a position command from the flow rate command, said position command being intended for the monitoring valve, (Ef) filtering the position command resulting from the step of determining the position command (E3), in which the filtering is carried out using a low-pass filter whose cutoff frequency fc is lower than a frequency (fo) of the engine speed oscillations about the cruise value Vc, the filter is a first-order low-pass filter, the monitoring valve is intended to supply air to a casing in order in order to modify its expansion and in which the cut-off frequency fc is greater than a frequency fr associated with the thermal response time of the casing, the cut-off frequency fc is comprised between 0.05 Hz and 0.15 Hz, the method comprises a sub-method for deactivating the filtering step Ef, implemented by the calculation unit, said sub-method comprising the following steps:

(E51) determining the gradient of the position command resulting from the step of determining a position command (E3), (E52) comparing this gradient with a deactivation threshold Sg, (E53) deactivating the filter if the gradient is greater than said threshold Sg, the method comprises a sub-method for activating the filtering step Ef, implemented by the calculation unit, said sub-method comprising the following steps:

(E61) determining the gradient of the position command resulting from the step of determining a position command (E3), (E62) comparing this gradient with an activation threshold Sg', (E63) activating the filter if the gradient is smaller than said threshold Sg' during at least one confirmation period, preferably the step of activating the filter (E63) is carried out if the altitude, the engine speed and the Mach also each verify a certain value, the determination step comprises the following sub-steps:

(E1) receiving data quantifying the engine speed of the turbomachine, (Ef) data-filtering the data quantifying the engine speed resulting from the preceding step, (E2, E3) determining a position command intended for the monitoring valve, in which the filtering is carried out using a low-pass filter whose cutoff frequency (fc) is less than a frequency (fo) of the engine speed oscillations about the cruise value (Vc).

The invention also proposes a system for controlling a valve for monitoring a turbomachine operating in engine speed at a cruise value Vc, said monitoring valve being intended to supply air to a casing in order to modify its expansion, said system comprising a monitoring valve and a calculation unit configured to implement the method as described above.

The calculation unit comprises a data receiving interface, a processor able to process data, a memory (for storing data) and a data output interface. Particularly, the calculation unit comprises a filtration block (typically the processor that executes operations), which performs the filtering operation.

The invention also proposes a turbomachine comprising a system as described above.

PRESENTATION OF THE FIGURES

Figure 2:
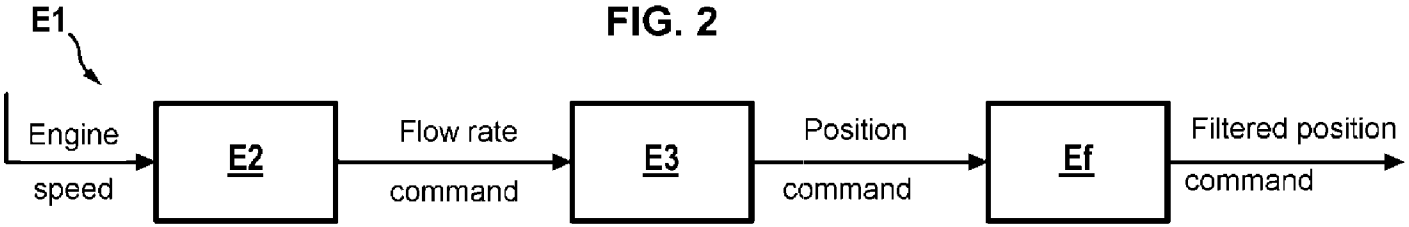
Figure 3:
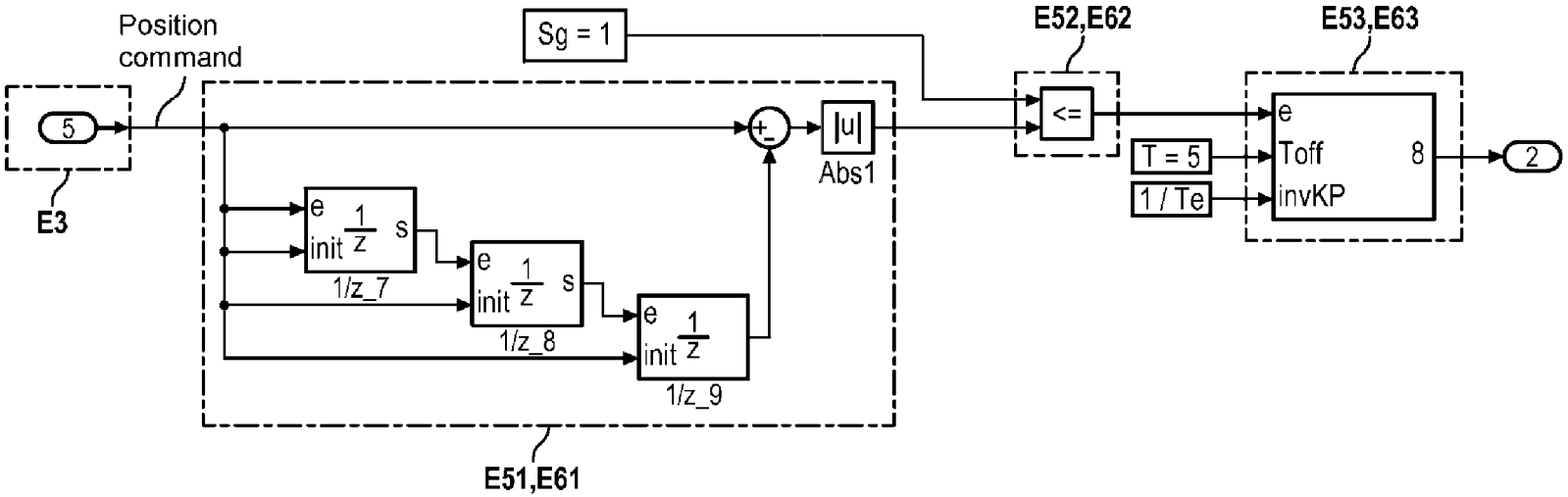
Figure 4:
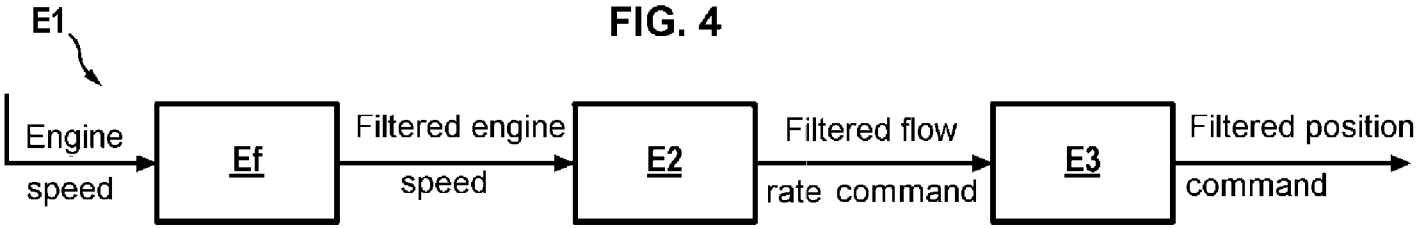
Figure 5:
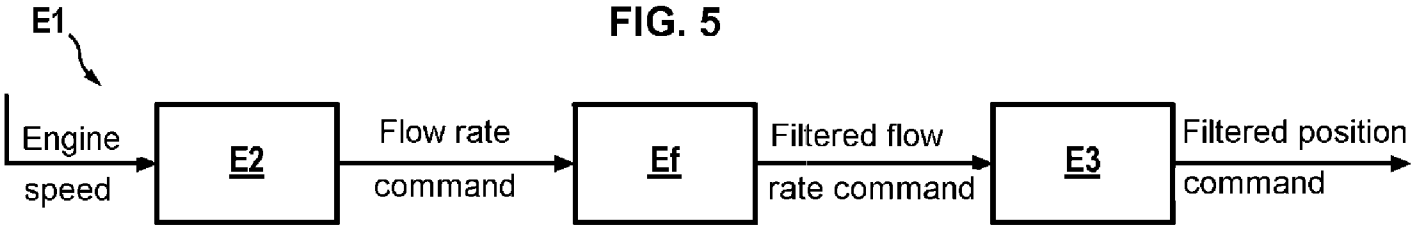

Other characteristics, objects and advantages of the invention will become apparent from the following description which is purely illustrative and non-restrictive and which should be read with reference to the appended drawings, in which:

FIG. 1*a* illustrates the overall architecture of a turbomachine,

FIG. 1*b* illustrates the overall architecture of the elements for monitoring the flow rate taken from the secondary flow path and sent to the casing opposite the turbine blades according to the state of the art, FIG. 2 illustrates in steps a mode of implementation of the invention, FIG. 3 illustrates the architecture in block diagram of a method for activating or deactivating the filter, complementary to the mode of implementation of FIG. 2, FIGS. 4 and 5 illustrate in steps other modes of implementation of the invention.

DETAILED DESCRIPTION

Several modes of implementation will now be described.

First Mode of Implementation

In a first mode of implementation presented in FIG. 2, the filtering step Ef is applied to the position command resulting from step E3, so that a filtered position command is obtained as output.

The advantage of such a filtering at the end of the method is that it is easily implementable on the software of the apparatuses in service and that it does not affect the integrity of the already existing code: its integration in an on board software is thus simplified.

In a preferred mode, the filtering is carried out with a first-order low-pass filter having a unique cut-off frequency fc.

The choice of the type of filter is based on the fact that the frequencies to be suppressed are much higher than the nominal behavior of the logic.

It is technically possible to put a second-order filter or higher but in order to limit the impact in terms of calculation time, preference will be given to the simplest filters.

The determination of the cut-off frequency fc is an important condition for obtaining an effective filtering that does not slow down the control method in a redhibitory manner.

The response time of the filter was chosen by a compromise between two constraints. Indeed, this response time must be high enough to remove a maximum of oscillations without slowing down the system in unacceptable proportions from a point of view of the thermal response of the casing. Indeed, a too low frequency would filter the nominal value of the command and the monitoring valve 20 would remain almost immobile.

Engine tests allow defining the thermal response of the casing and obtaining a characteristic response time (and its associated frequency). Insofar as the thermal response of the casing is generally different at different points, the most restrictive case is chosen to delimit the minimum response time (that is to say the maximum frequency at which the cutoff frequency must remain lower). Insofar as a frequency fr associated with the most restrictive response time of the casing 16 (that is to say the lowest response time among the measurements made on the casing 16) is generally much smaller than the frequency fo of the oscillations, it can be ensured that the cutoff frequency fc is greater than the frequency fr associated with the response time of the casing 16 without introducing too much constraints on the frequency fc.

These conditions on the cutoff frequency guarantee the performances of the system.

The frequency fo of the micro-oscillations has also been estimated, which made it possible to determine a lower limit of the response time, and therefore an upper limit for the cut-off frequency fc.

For example, depending on the frequency fo, a cut-off frequency fc of between 0.05 and 0.15 Hz, or even 0.08 and 0.12 Hz or more broadly between 0.01 and 0.20 Hz, is chosen. For the record, the frequency fo is of about 1 Hz, which is quite far from the previous upper limits to ensure efficient filtering. For cutoff frequencies fc in the latter interval, it is ensured to have response times lower than those of the casing 16.

Nevertheless, the addition of the filter slows down a bit the system and should be preferably applied only in relevant flight phases. In this case, it is desired to apply this filtering only in cruise flight condition, that is to say when the engine speed is in steady state (speed at which the oscillations at the frequency fo are observed).

A condition for the application of the filter is primarily related to the cruise speed. For this, three indicators are verified:

The engine speed,

The Mach (that is to say the ratio of the local speed in a fluid on the speed of sound in this same fluid), The altitude.

Several values related to these indicators are predetermined to characterize a cruise phase. If the cruise phase is confirmed, then the filtering step can be activated.

In addition, when the system requires a rapid reaction of the monitoring valve 20, it is desired that the command is not slowed down by a filter (for example an action of the pilot, during takeoff or landing or for example upon a sudden change of environment).

Preferably, the method complementarily comprises a sub-method for deactivating the filter. FIG. 3 represents a block diagram indicating the different steps of this sub-method.

In a step E51, the gradient between two instants (that is to say the variation between two values at two instants of a digital signal) of the position command resulting from step E3, is determined. It is therefore not the filtered command. For this, several cascade delay blocks can be used (the number of three is related to the internal logic of the calculation unit 40, for which the iteration rate is of 0.240 s, namely 0.720 s for the three iterations).

In a step E52, this gradient is compared with a deactivation threshold value Sg. More precisely, in order to overcome the questions of signs, the absolute value of this gradient is compared with the deactivation threshold value Sg.

Finally, in a step E53, the filtering step Ef is deactivated if the gradient is greater than or equal to said threshold Sg.

By way of example, a threshold value is chosen which is comprised between 0.5 and 2.5% per second, that is to say, at one second intervals, the command varies between 0.5 and 2.5% from its original value. In the diagram, the threshold value is of 1% for 0.72 second, namely 1.4% per second. An interval of 1 and 2% per second may also be suitable.

A gradient greater than the threshold Sg means that it is not a micro-oscillation that is detected, but indeed a relevant change for the system that can have an impact on the casing 16.

Thus, as soon as the valve is more urged, the filtering stops and the system recovers its conventional operation. In this deactivation sub-method, the value analyzed is the control gradient and not the physical measurement given by the sensors: the solution would take into account the filtering (since the position command has been filtered) and would be too slow.

The reactivation (or activation) of the filtering step is also carried out under condition using another sub-method, also represented in FIG. 3.

In steps E61, E62 similar to steps E51 and E52 respectively, the gradient is compared with an activation threshold value Sg'.

The activation threshold value Sg' may or may not be identical to the deactivation threshold value Sg. If it is desired that the activation of the filter is made more selectively, it is possible to set the threshold value Sg' lower than the threshold value Sg. In FIG. 3, Sg=Sg'.

In a step E63, the filtering step Ef is activated if the gradient remains smaller than the threshold Sg' during a set confirmation period T. The confirmation period T is comprised between two and eight seconds (T=5 s in FIG. 3), or even 4 and 6 seconds.

The additional conditions of the cruise phase (Mach, altitude and engine speed) are also analyzed here.

Step E63 is misrepresented in FIG. 3, since the drawn block outputs an activation condition, which is then preferably combined with the other activation conditions to effectively activate the filter.

If the three additional conditions are met (engine speed at a certain value, Mach at a certain value and altitude at a certain value), then the filter can be re-set.

Thus, it is ensured that the system is stable and that the engine is in cruise speed before reactivating the filtering step Ef and suppressing the oscillations.

Second Mode of Implementation

In a second mode of implementation represented in FIG. 4, the filtering step Ef is applied to the engine speed data resulting from step E1, so that a filtered position command is again obtained as output. The step of determining a flow rate command E2 is then carried out from the filtered data relating to the engine speed.

Such filtering at the beginning of the method for calculating the position command allows avoiding the processing of data with noise.

In such a mode of implementation, the filtering is preferably integrated in fact in step E2 of determining a flow rate command.

Embodiments with activation and deactivation thresholds may also be implemented.

Third Mode of Implementation

It is also conceivable to apply the filtering step to the flow rate command resulting from step E2. The step of determining the position command E3 is then carried out from one filtered flow rate command data. This embodiment is illustrated in FIG. 5.

Embodiments with activation and deactivation thresholds may also be implemented.

The invention claimed is:

1. A method implemented by a calculation unit, the method comprising:

monitoring, by a monitoring valve that directs air flow from a flow path toward a casing disposed opposite blades in a turbine of a turbomachine, an air flow rate from the flow path; and receiving a value of an engine speed of the turbomachine at a cruise value, the value of the engine speed oscillating about the cruise value and determining, for the monitoring valve, a position command for the monitoring valve based on the engine speed; and controlling the monitoring valve based on the determined position command, wherein the position command is determined by:

receiving data quantifying the engine speed of the turbomachine, determining a flow rate command from the data quantifying the engine speed, determining the position command from the flow rate command, and filtering, from the oscillations of the engine speed about the cruise value, the position command.

2. The method according to claim 1, wherein the filtering is carried out using a low-pass filter whose cutoff frequency is greater than a frequency associated with the thermal response time of the casing.

3. The method according to claim 2, wherein the low-pass filter is a first-order filter.

4. The method according to claim 2, wherein said monitoring valve is configured to supply air to an inside of the casing in order to modify an expansion of the casing.

5. The method according to claim 2, wherein the cutoff frequency is between 0.05 Hz and 0.15 Hz.

6. The method according to claim 2, comprising deactivating the filtering by:

determining a gradient of the position command, comparing the gradient with a deactivation threshold, and deactivating the filter if the gradient is greater than the deactivation threshold.

7. The method according to claim 2, comprising activating the filtering by:

determining a gradient of the position command, comparing the gradient with an activation threshold, activating the filter if the gradient is smaller than the activation threshold during at least one confirmation period.

8. The method according to claim 7, wherein the filtering is activated if the gradient is smaller than the activation threshold and if each of the engine speed, an altitude, and a Mach are at respective corresponding values.

9. The method according to claim 2, wherein filtering the position command comprises filtering the data quantifying the engine speed.

10. The method according to claim 1, wherein the filtering is carried out using a low-pass filter whose cutoff frequency is less than a frequency of the engine speed oscillations about the cruise value.

11. A system comprising:

a monitoring valve;

a filtration block; and a calculation unit that is configured to execute the following operations:

monitoring, by the monitoring valve that directs air flow from a flow path toward a casing disposed opposite blades in a turbine of a turbomachine, an air flow rate from the flow path; and receiving a value of an engine speed of the turbomachine at a cruise value, the value of the engine speed oscillating about the cruise value and determining, for the monitoring valve, a position command for the monitoring valve based on the engine speed; and controlling the monitoring valve based on the determined position command, wherein the position command is determined by:

receiving data quantifying the engine speed of the turbomachine, determining a flow rate command from the data quantifying the engine speed, determining the position command from the flow rate command, and filtering, by the filtering block from the oscillations of the engine speed about the cruise value, the position command.

12. A turbomachine comprising the system according to claim 11.

* * * * *